United States Patent [19]

Matkovic

[11] Patent Number: 5,044,038

[45] Date of Patent: Sep. 3, 1991

[54] FOLDABLE PAINT BRUSH HOOK ASSEMBLY

[76] Inventor: Zvonko Matkovic, 1401 Mary Ave., Lansing, Mich. 48910

[21] Appl. No.: 465,430

[22] Filed: Jan. 16, 1990

[51] Int. Cl.[5] ..... A46B 11/00

[52] U.S. Cl. ..... 15/159 R; 15/143 R; 15/246; 248/110; 248/691; 248/692

[58] Field of Search ..... 15/143 R, 159 R, 246, 15/257 R; 211/65; 248/110 X, 303, 308, 691 X, 692 X, 685, 689, 690

[56] References Cited

U.S. PATENT DOCUMENTS

| | | | |
|---|---|---|---|
| 888,896 | 5/1908 | Howard | 15/246 |
| 1,028,547 | 6/1912 | Copeland | 15/143 R |
| 1,228,774 | 6/1917 | Hecht | 248/685 |
| 1,277,019 | 8/1918 | Wright | 248/685 |
| 1,313,515 | 8/1919 | Caffrey | 248/692 |
| 1,696,089 | 12/1928 | Huey | 248/308 |
| 2,309,990 | 2/1943 | Savi . | |
| 2,447,764 | 8/1948 | McCain | 15/246 |
| 2,905,419 | 9/1959 | Carson . | |
| 2,988,768 | 6/1961 | Hill . | |
| 3,082,990 | 3/1963 | Nelson | 248/308 |
| 3,179,363 | 4/1965 | Sheiman | 248/308 |
| 3,223,375 | 12/1965 | Bernasconi | 248/308 |
| 3,231,919 | 2/1966 | MacDonald | 15/246 |
| 3,612,464 | 10/1971 | Harrah . | |
| 4,025,980 | 5/1977 | Neil . | |
| 4,757,568 | 7/1988 | Jones . | |

FOREIGN PATENT DOCUMENTS

| | | | |
|---|---|---|---|
| 53086 | 5/1937 | Denmark | 248/308 |

*Primary Examiner*—Edward L. Roberts
*Assistant Examiner*—Mark Spisich
*Attorney, Agent, or Firm*—Ian C. McLeod

[57] ABSTRACT

A foldable hook assembly (11, 30) for a paint brush (10) is described. A hook (20, 32) in foldable laterally on a body (12) of the brush so as to be out of the way when the brush is used for painting.

9 Claims, 1 Drawing Sheet

FOLDABLE PAINT BRUSH HOOK ASSEMBLY

BACKGROUND OF THE INVENTION (1) Field of the Invention

The present invention relates to a foldable hook assembly which allows a paint brush to be stored on the side of a paint container when not in use and folded out of the way when the brush is in use. In particular, the present invention relates to a hook assembly wherein the hook folds laterally of the longitudinal axis of the brush when in use.

(2) Prior Art

U.S. Pat. No. 2,309,990 to Savi; U.S. Pat. No. 2,905,419 to Carson; U.S. Pat. No. 2,988,768 to Hill; U.S. Pat. No. 3,612,464 to Harrah; U.S. Pat. No. 4,025,980 to Neil; and U.S. Pat. No. 4,757,568 to Jones describe various types of fixed hooks for paint brushes In each instance the hook is in a fixed position and projects from a side of the paint brush. The problem has been that the hooks interfere with the use of the paint brush, particularly in corners being painted.

OBJECTS

It is therefore an object of the present invention to provide an improved hook assembly for a paint brush which allows the hook to be folded against the body of the brush. It is further an object of the present invention to provide a hook assembly which is very inexpensive to fabricate and is easy to install on the paint brush. These and other objects will become increasingly apparent by reference to the following description and the drawings.

IN THE DRAWINGS

FIG. 1 is a perspective view of a brush 10 mounted on a lip 100*a* of a container 100 by means of a foldable hook assembly 11.

GENERAL DESCRIPTION

The present invention relates to an improved paint applicator or brush with a support hook which comprises: a paint applicator having body means with a handle means as an extension of the body means at one end of the applicator and having opposed sides and paint means mounted at an opposite end of the brush and extending from the body means; hook means pivotably mounted on one side of the body means and moveable into a folded position on the body means and an upright portion which extends from the body means to support the applicator in a vertical orientation on an edge of a container means with the paint means in a lowermost position; and retainer means mounted on the body means which holds the hook means in position in the folded position and upright position upon movement from one of the positions.

The present invention also relates to a holder to be mounted on a paint applicator having a body means with a handle means as an extension of the body means at one end of the brush and having opposed sides and paint means mounted at an opposite end of the applicator and extending from the body means which comprises: hook means which is to be pivotably mounted on the body and moveable into a folded position on the body means and an upright position which extends from the body means to support the applicator in a vertical orientation on an edge of a container means with the paint means in a lowermost position; and retainer means which is to be mounted on the body means which holds the hook means in the folded position and in the upright position upon movement from one of the positions.

SPECIFIC DESCRIPTION

Figure 1:
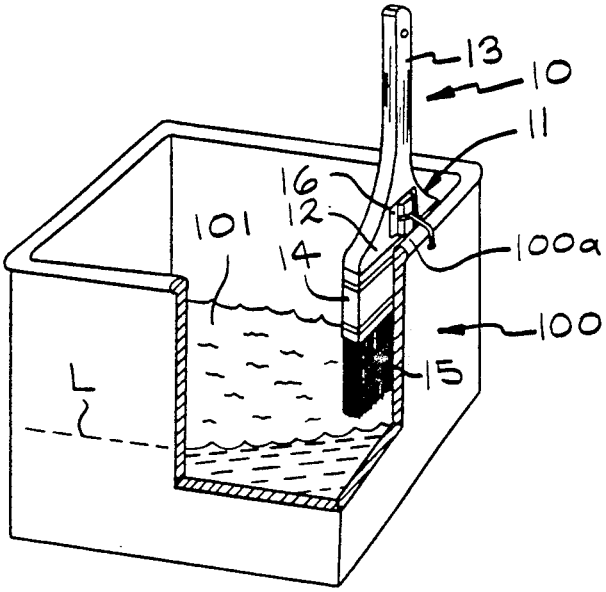

FIG. 1 shows the improved paint brush 10 of the present invention mounted on a container 100 containing paint 101 normally at a level L below the brush 10. The paint brush 10 is provided with a hook assembly 11 for holding the brush 10 on upper edge 100*a* of the container 100.

Figure 2:
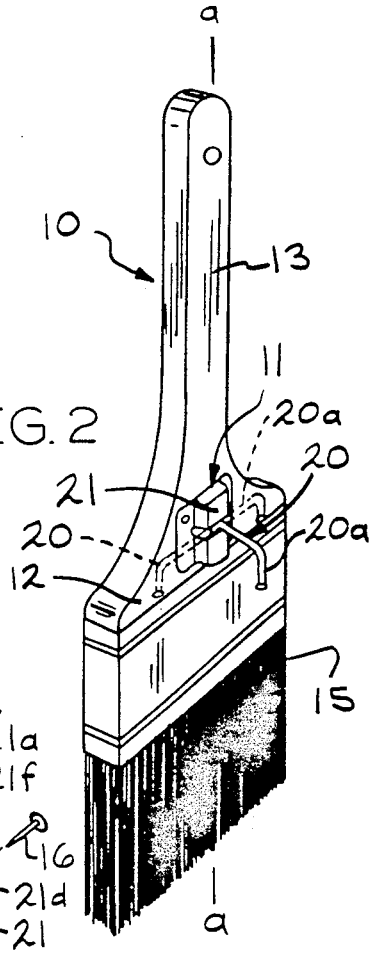
FIG. 2 is a perspective enlarged view of the brush 10 and assembly 11 shown in FIG. 1.
Figure 3:
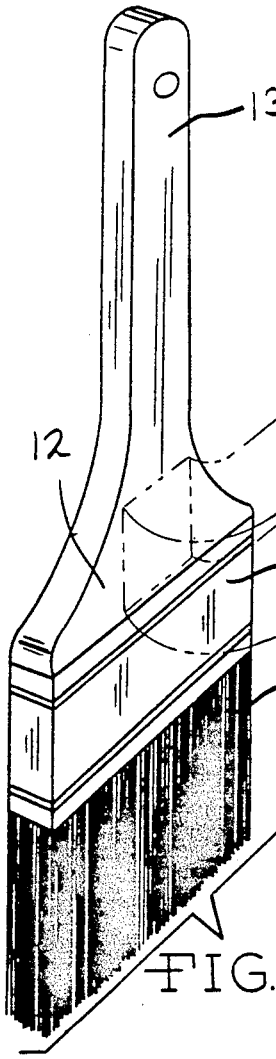
FIG. 3 is a perspective separated view of the preferred foldable hook assembly 11 of FIGS. 1 and 2.

FIGS. 2 and 3 show enlarged views of the brush 10 including conventional body portion 12 from which handle 13 projects. The body portion 12 supports a ferrule 14 which in turn holds bristles 15. The hook assembly 11 is mounted on the body portion 12 by means of nails or screws 16 or other fastening means. Preferably the fastening means allows the assembly 11 to be removed from the body portion 12 to allow transfer of the hook assembly 11 after the paint brush 10 is worn out.

FIG. 3 shows the hook assembly 11 including hook 20 including an extension 20*a* which is in essentially parallel spaced relationship to the longitudinal axis a-a of the brush 11. A connection member 20*b* is provided perpendicular to a central portion 20*c* and parallel to the extension 20*a*. The hook 20 is mounted in a holder 21 through an opening 21*a*. Coil springs 22 and 23 are mounted on the connection member 20*b* on either side of the central portion 20*c*. Extensions 22*a* and 23*a* are secured on the holder 21 by an adhesive (not shown) or through holes 21*b* and 21*c* on support 21*d* to aid in holding the springs 22 and 23 in raised portion 21*e* of holder 21. Holder 21 is provided with holes 21*f* for nails or screws 16 to hold the assembly 11 on the body 12 of brush 11. The springs 22 and 23 have a friction fit on connection member 20*b*. This enables the hook 20 to be moved laterally by hand against the body 12 as shown by the dotted lines in FIGS. 2 and 3, so that the hook 12 is out of the way during painting. The hook 12 is easily moved out of the way into the folded position or back into an upright position using the thumb.

Figure 4:
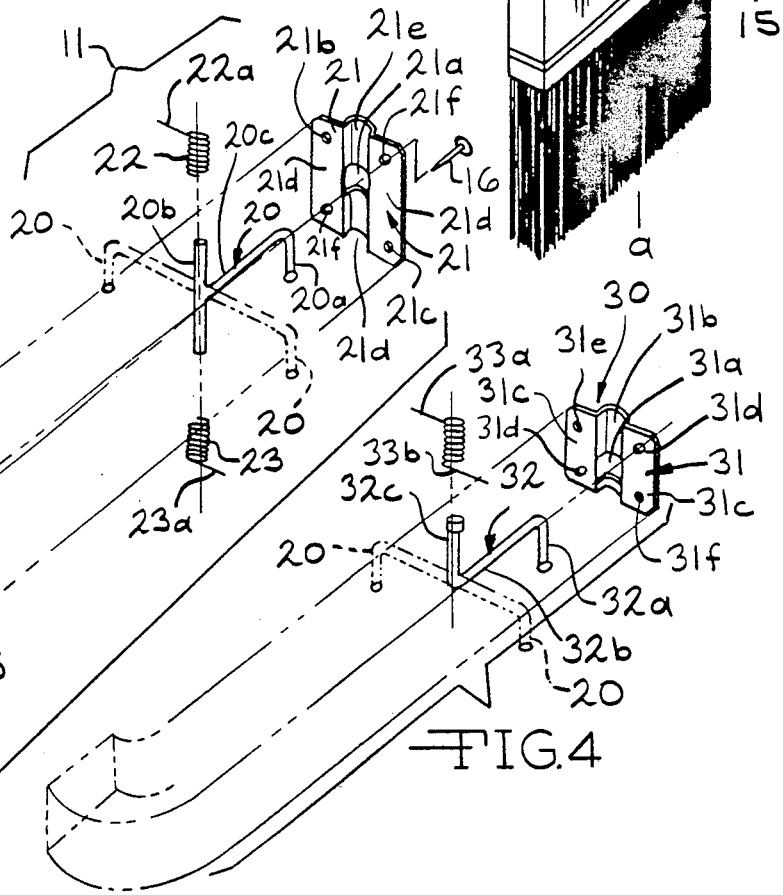
FIG. 4 is a perspective separated view of another preferred hook assembly 30.

FIG. 4 shows a different type of hook assembly 30. A holder 31 is mounted on the body 12 of the brush 11. Hook 32 extends through opening 31*a* in raised portion 31*b* of holder 31. Holes 31*d* are provided in support 31*c* for nails or screws 16. Hook 32 includes extension 32*a*, central portion 32*b* and connection member 32*c*. Spring 33 with extensions 33*a* and 33*b* is in friction fit around the connection member 32*c*. The extensions 33*a* and 33*b* are secured to the holder as in FIG. 1 in holes 31*e* and 31*f* or can be held by the holder 31 and body 12 of the brush 10. The hook 32 folds as shown by the broken lines in FIG. 4 laterally against the body 12 of the brush 11.

In use the brush 10 is hung on the edge 100*a* of container 100 by means of hook 20 or 32 in an upright position. When the brush 10 is to be used the hook 20 or 32 is moved laterally, the bristles 15 can be dipped in the paint 101. The hook 20 or 32 then does not interfere with the painting, particularly in corners or the like.

Various foldable hook means can be used so long as the hook remains in an upright or folded position when positioned. Various detent means (not shown) which engage the connection means 20 or 32 can be used in a manner well known to those skilled in the art. The springs 22 and 23 and 32 are preferred.

It is intended that the foregoing description be only illustrative of the present invention and that the present invention be limited only to the hereinafter appended claims.

I claim:

1. An improved paint applicator with a support hook which comprises:

(a) a paint applicator having opposed ends and having body means with a handle means as an extension of the body means at one of the ends of the applicator and having at least one side and paint means mounted at the other of the ends of the applicator and extending from the body means, wherein the handle means defines a longitudinal first axis through the body means;

(b) a hook means pivotably mounted on the one side of the body means and moveable between a folded position adjacent to the body means and an upright position which extends from the body means to support the applicator in a vertical orientation on an edge of a container means with the paint means in a lowermost position wherein the hook means attaches to the body means on a connection portion of the hook means along a second axis which is parallel to the first axis and pivots between the folded and upright positions on the second axis and wherein the user can raise and lower the hook means with a thumb of a hand while holding the handle means with the hand during painting; and;

(c) a retainer means mounted on the one side of the body means by fastening means with means mounted in the retainer means that frictionally engages the connection portion of the hook means so that the retainer means holds the hook means in position in the folded position and upright position upon movement from one of the positions.

2. An improved paint brush with a support hook which comprises:

(a) a paint brush having opposed ends and having a body means with a handle means as an extension of the body means at one of the ends of the brush and having at least one side and paint means mounted at the other of the ends of the brush and extending from the body means, wherein the handle means defines a longitudinal first axis through the body means;

(b) a hook means pivotably mounted on the one side of the body means and moveable between a folded position adjacent to the body means and an upright position which extends from the body means to support the brush in a vertical orientation on an edge of a container means with the paint mean sin a lowermost position, wherein the hook means attaches to the body means on a connection portion of the hook means mounted along a second axis which is parallel to the first axis and pivots between the folded and upright positions on the second axis and wherein a user can raise and lower the hook means with a thumb of a hand while holding the handle means with the hand during painting; and (c) means mounted on the connection portion of the hook means in a holder means adjacent the body means which frictionally engages the connection portion of the hook means to hold the hook means in the upright or folded position upon movement from one of the positions, wherein the holder means is mounted on the one side of the body means by fastening means.

3. The brush of claim 2 wherein the means is a friction means as a coil spring means, mounted in the holder means which is secured to the body means.

4. The brush of claim 3 wherein the holder means has a raised portion between two supports which mount on the body means and wherein the coil spring means is mounted on the connection portion and in the raised portion of the holder means.

5. The brush of claim 4 wherein the coil spring means has opposed ends and a projection at each of the opposed ends which are held in place by the supports of the holder means.

6. A holder adapted to be mounted on a paint applicator having opposed ends and having a body means with a handle means as an extension of the body means at one of the ends of the applicator and having at least one side and paint means mounted at the other of the ends of the applicator and extending from the body means, wherein the handle means defines a longitudinal first axis through the body means, which comprises:

(a) a hook means which is to be pivotably mounted on the body means and moveably between a folded position adjacent to the body means and an upright position which extends from the body means to support the applicator in a vertical orientation on an edge of a container means with the paint means in a lowermost position wherein the hook means attaches to the body means on a connection portion of the hook means mounted along a second axis which is parallel to the first axis and pivots between the folded and upright positions on the second axis and wherein a user can raise and lower the hook means with a thumb of a hand while holding the handle means with the hand during painting; and (b) a retainer means for mounting the holder on the one side of the body means by fastening means with means mounted in the retainer means that frictionally engages the connection portion of the hook means to hold the hook means in the folded position and in the upright position upon movement from one of the positions.

7. The hook of claim 6 wherein the means is a friction means as a coil spring means.

8. The holder of claim 7 wherein the coil spring means is mounted on the connection portion and in a raised portion of the holder means which projects away from the body means of the applicator when the holder means is mounted on the applicator.

9. The holder of claim 8 wherein the coil spring means has at least one extension which holds the coil spring means in place in the raised portion of the holder means.

* * * * *